US009982507B2

(12) United States Patent
Murphree et al.

(10) Patent No.: US 9,982,507 B2
(45) Date of Patent: May 29, 2018

(54) INTERNALLY TRUSSED HIGH-EXPANSION SUPPORT FOR REFRACTURING OPERATIONS

(71) Applicant: Halliburton Energy Services, Inc., Houston, TX (US)

(72) Inventors: Zachary Ryan Murphree, Dallas, TX (US); Michael Linley Fripp, Carrollton, TX (US); Darrell Adkins, Dallas, TX (US); John Gano, Lowry Crossing, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 239 days.

(21) Appl. No.: 14/783,217

(22) PCT Filed: Oct. 29, 2014

(86) PCT No.: PCT/US2014/062938
§ 371 (c)(1),
(2) Date: Oct. 8, 2015

(87) PCT Pub. No.: WO2016/068917
PCT Pub. Date: May 6, 2016

(65) Prior Publication Data
US 2016/0312567 A1 Oct. 27, 2016

(51) Int. Cl.
*E21B 33/127* (2006.01)
*E21B 43/26* (2006.01)
(Continued)

(52) U.S. Cl.
CPC ..... *E21B 33/127* (2013.01); *E21B 29/10* (2013.01); *E21B 43/11* (2013.01); *E21B 43/26* (2013.01)

(58) Field of Classification Search
CPC combination set(s) only.
See application file for complete search history.

(56) References Cited

U.S. PATENT DOCUMENTS 6,607,032 B2 * 8/2003 Voll ..... B01D 29/111 166/206
6,695,054 B2 2/2004 Johnson et al.
(Continued)

OTHER PUBLICATIONS

International Search Report and Written Opinion issued in related PCT Application No. PCT/US2014/062938 dated Jul. 29, 2015, 15 pages.

*Primary Examiner* — Kyle Armstrong
(74) *Attorney, Agent, or Firm* — Scott Richardson; Baker Botts L.L.P.

(57) ABSTRACT

A downhole system and method is disclosed for sealing a previously perforated section of casing and refracturing the subterranean formation in a region of the subterranean formation remote from those regions previously fractured. The system includes a truss structure radially expandable between a contracted configuration and an expanded configuration and a sealing structure disposed radially external to the truss structure. The truss structure and the sealing structure are set in their expanded configurations so that the sealing structure is put into engagement with the perforated section of casing so as to restrict the flow of fluids from the perforated section of production tubing into the subterranean formation.

20 Claims, 6 Drawing Sheets

(51) Int. Cl.
*E21B 29/10* (2006.01)
*E21B 43/11* (2006.01)

(56) References Cited

U.S. PATENT DOCUMENTS

| | | | | |
|---|---|---|---|---|
| 6,755,249 | B2 * | 6/2004 | Robison | E21B 43/103 166/262 |
| 7,048,067 | B1 * | 5/2006 | Cook | E21B 43/105 166/207 |
| 7,478,676 | B2 * | 1/2009 | East, Jr. | E21B 13/1208 166/191 |
| 7,669,653 | B2 * | 3/2010 | Craster | E21B 23/06 166/101 |
| 8,230,913 | B2 * | 7/2012 | Hart | E21B 33/1208 166/207 |
| 8,733,453 | B2 * | 5/2014 | Guerrero | E21B 4/18 166/207 |
| 2002/0046840 | A1 | 4/2002 | Schetky et al. | |
| 2002/0107562 | A1 | 8/2002 | Hart et al. | |
| 2003/0079886 | A1 | 5/2003 | Schetky et al. | |
| 2003/0089496 | A1 | 5/2003 | Price-Smith et al. | |
| 2004/0020660 | A1 | 2/2004 | Johnson et al. | |
| 2004/0026079 | A1 | 2/2004 | Johnson et al. | |
| 2004/0074642 | A1 | 4/2004 | Price-Smith et al. | |
| 2004/0084176 | A1 | 5/2004 | Hackworth et al. | |
| 2004/0089454 | A1 | 5/2004 | Hackworth et al. | |
| 2005/0178551 | A1 | 8/2005 | Tolman et al. | |
| 2011/0214855 | A1 | 9/2011 | Hart et al. | |
| 2013/0186625 | A1 | 7/2013 | O'Malley | |
| 2013/0220640 | A1 | 8/2013 | Fripp et al. | |
| 2013/0220641 | A1 | 8/2013 | Fripp et al. | |
| 2013/0220642 | A1 | 8/2013 | Fripp et al. | |
| 2013/0220643 | A1 | 8/2013 | Fripp et al. | |
| 2013/0220644 | A1 | 8/2013 | Fripp et al. | |
| 2014/0131035 | A1 | 5/2014 | Entchev et al. | |

* cited by examiner

INTERNALLY TRUSSED HIGH-EXPANSION SUPPORT FOR REFRACTURING OPERATIONS

CROSS-REFERENCE TO RELATED APPLICATION

The present application is a U.S. National Stage Application of International Application No. PCT/US2014/062938 filed Oct. 29, 2014, which is incorporated herein by reference in its entirety for all purposes.

TECHNICAL FIELD

The present disclosure relates to wellbore completion operations and, more particularly, to a downhole completion assembly for sealing and supporting a previously perforated section of production casing.

BACKGROUND

The development of subterranean operations and the processes involved in removing hydrocarbons from a subterranean formation typically involve a number of different steps, including but not limited to, drilling a wellbore at a desired well site, in some cases fortifying the wellbore to prevent its collapse, and treating the region immediately adjacent the wellbore to enhance the recovery of the hydrocarbons from the formation into the wellbore. There are a number of different ways of enhancing the recovery the hydrocarbons from the subterranean formation once the wellbore has been drilled into the region of interest. Over the past decade or so, hydraulic fracturing has become one of the widely accepted techniques for optimizing the recovery of these hydrocarbons from subterranean formations because it expands the number and length of pathways for the oil and gas to make their way from the subterranean formation to the wellbore for subsequent recovery.

Presently, there are many wells that were hydraulically fractured, which are producing much less than they had previously or never produced as expected. Such wells include wells which were completed early in a specific field's development, for example, when little was known about how the specific field behaved, wells where insufficient proppant was placed in the fractures initially, wells where high production rates caused fracture collapse, and/or wells where perforations were spaced too widely. Many of these wells still have sufficient oil and gas worth recovering. Indeed, operators stand to benefit from refracturing many of these wells. However, before these wells can be refractured, the existing perforations have to be sealed so that the fracturing treatment is delivered to the new perforations and not lost through into the formation through the old perforations. Accordingly, there is a need for a method and/or apparatus for sealing these existing perforations so that the formation can be reperforated and refractured in new and more productive zones.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

The present disclosure provides a downhole completion system that features an expandable sealing structure and corresponding internal truss structure that are capable of being run through existing production casing and subsequently expanded to support and seal the internal surface of a perforated portion of casing so as to restrict the flow of fluids from the wellbore into the casing in a previously fractured region. Once the sealing structure is run to its proper downhole location, which in most cases will be a previously fractured portion of production casing, it may be expanded by any number of expansion tools that are also small enough to axially traverse the casing. In operation, the expanded sealing structure may be useful in sealing the perforations thereby restricting the influx of fluids into the easing through the old perforations. The internal truss structure may be arranged within the sealing structure and useful in radially supporting the expanded sealing structure. In some embodiments, the sealing structure and corresponding internal truss structure are expanded at the same time with the same expansion tool.

The downhole completion system may provide advantages in that it is small enough to be able to be run-in through existing casing. When expanded, the disclosed downhole completion system may provide sufficient expansion within a perforated portion of the casing to adequately restrict the influx of formation fluids. After restricting this flow, a nearby section of the wellbore may be perforated and then fractured to form new perforations using fracturing techniques that promote increased recovery of production fluids from the formation. As a result, the productivity and life of a well may be extended, thereby increasing profits and reducing expenditures associated with the well. As will be appreciated by those of ordinary skill in the art, the methods and systems disclosed herein may salvage or otherwise revive certain types of wells, which were previously thought to be economically unviable.

Figure 1:
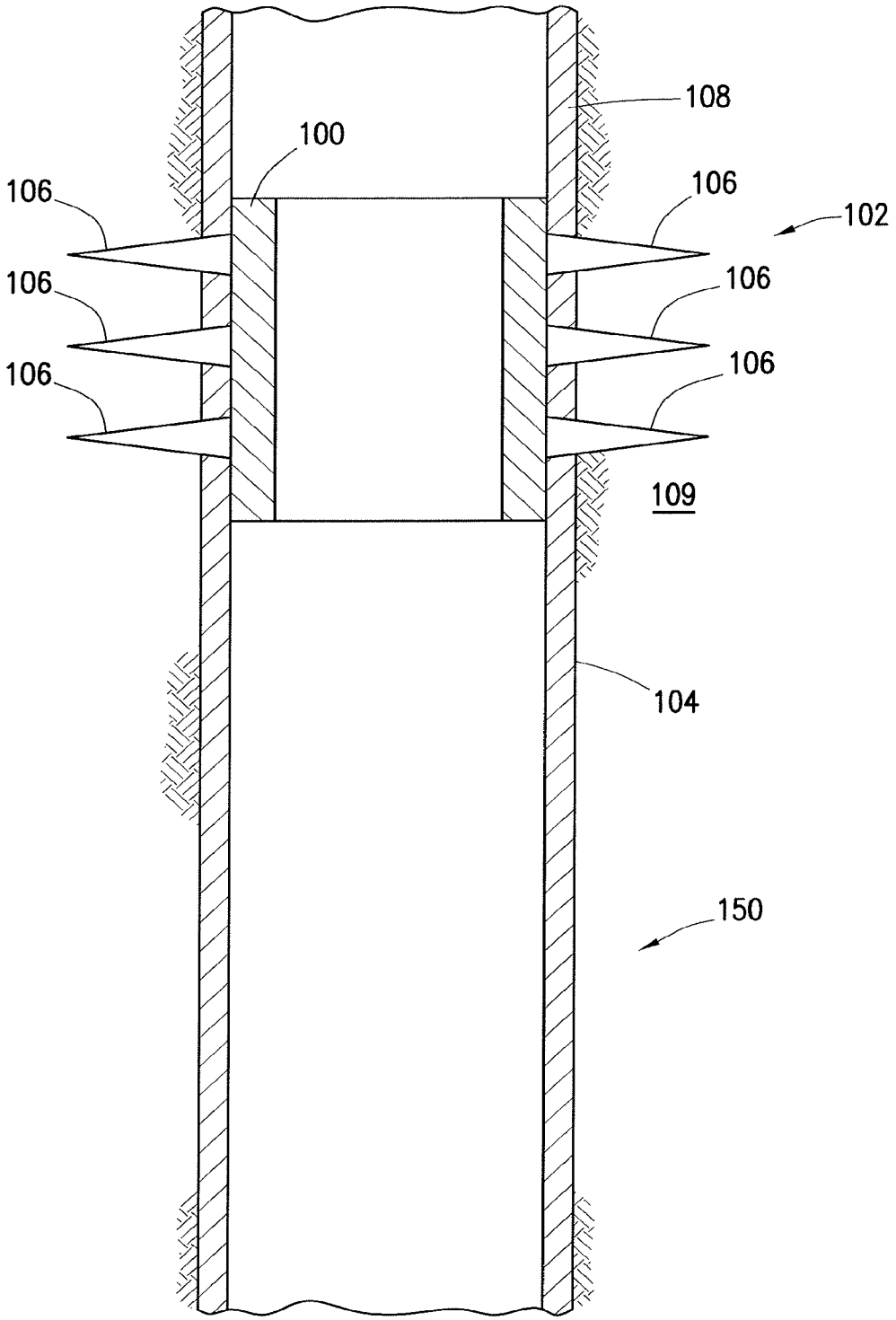
FIG. 1 illustrates a downhole completion system used to seal previously formed perforations in a nonproductive zone of an existing wellbore, according to one or more embodiments.

Referring to FIG. 1, illustrated is an exemplary downhole completion system 100, according to one or more embodiments disclosed. As illustrated, the system 100 may be configured to be arranged in a previously fractured section 102 of a wellbore 104 to seal perforations 106 that were previously formed along the casing 108. Specifically, the system 100 seals against the perforations 106 and thereby creates a fluid impermeable barrier between the subterranean formation 109 and the inside of the casing 108. As used herein, the term "casing" is intended to be understood broadly so as to encompass casing and/or liners. For example, the illustrated casing 108 is cemented into place against the wellbore wall of the formation 109. Furthermore, as used, herein, the term or phrase "downhole completion system" should not be interpreted to refer solely to wellbore completion systems as classically defined or otherwise generally known in the art. Rather, the downhole completion system may also refer to, or be characterized as, a downhole fluid transport system. For instance, the downhole completion system may not necessarily be connected to any casing or the like. As a result, in some embodiments, fluids conveyed through the downhole completion system 100 may exit the system 100 into the casing 108, without departing from the scope of the disclosure.

While FIG. 1 depicts the system 100 as being arranged in the fractured section 102 of a vertically-oriented wellbore 104, it will be appreciated that the system 100 may be equally arranged in a horizontal or slanted portion of the wellbore 104, or any other angular configuration therebetween, without departing from the scope of the disclosure. Furthermore, in some embodiments the system 100 may be arranged in one of several existing fractured sections 102 along the length of the casing 108.

In present embodiments, the system 100 includes a truss structure and a sealing structure disposed around the truss structure. The system 100 may be run in through the casing 108 until it reaches the fractured section 102 and is brought into alignment with the perforations 106 in the fractured section 102. From this position, as described in detail below, an expansion tool may be actuated to expand the truss structure and the sealing structure of the system 100 against an inner portion of the perforated casing 108, thereby sealing the perforations 106.

Figure 2A:
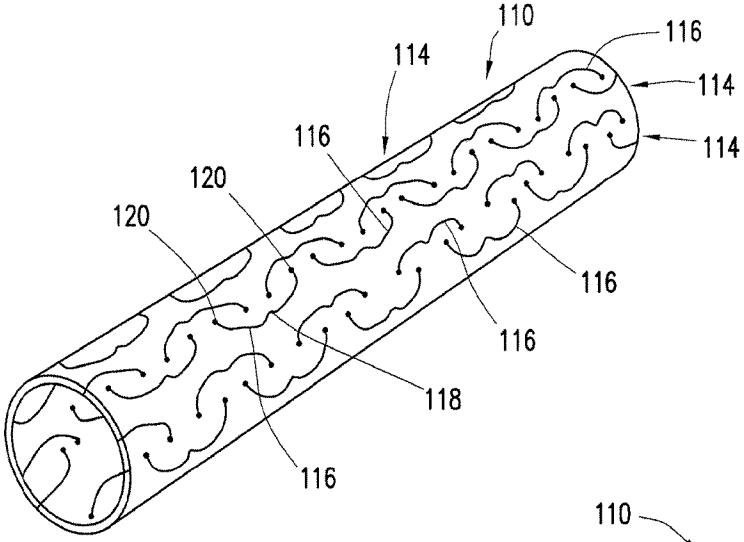
FIGS. 2A and 2B illustrate contracted and expanded sections of a truss structure, respectively, according to one or more embodiments.
Figure 2B:
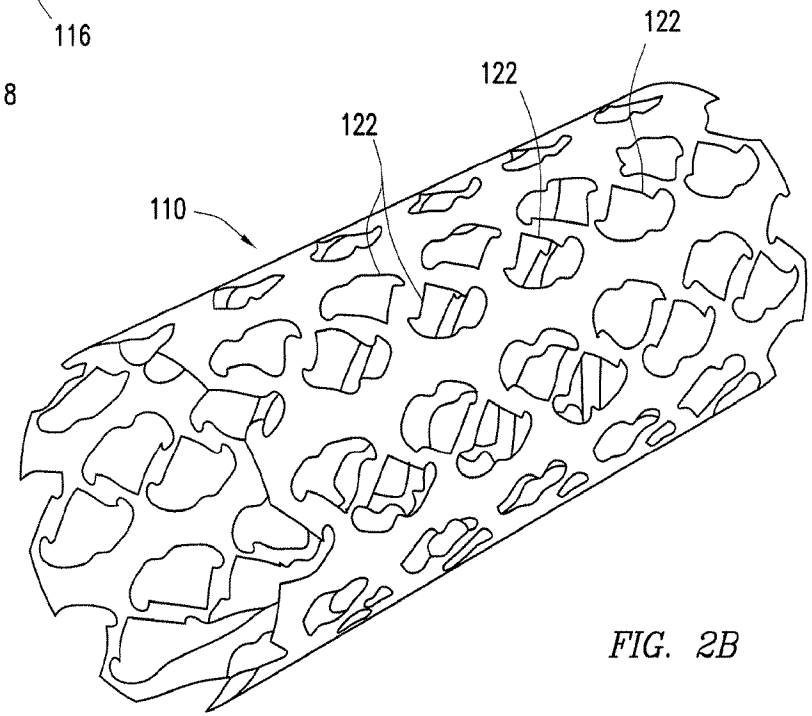

Having generally described the context in which the disclosed downhole completion system 100 may be utilized, a more detailed description of the components that make up the system 100 will be provided. To that end, FIGS. 2A and 2B illustrate the truss structure 110 of the system 100. In one embodiment, the truss structure 110 is formed of a stainless steel tube, which has a pattern cut into it that enables it to expand in diameter more than 50% and up to approximately 300% without changing axial length, while at the same time maintaining a useful strength. It should be noted that any suitable expansion range is contemplated for the expanded diameter of the tube without changing its axial length. The tube serves as the support structure upon which a separate sealing layer is added. In some embodiments, a feature of the pattern is that it enables the the tube to expand radially into a trussed shape that is internal to the outer sealing layer. The term "trussed shape" refers to the expanded pattern of the tube having open spaces outlined by interconnected portions of the tube (e.g., trusses). These trusses may provide additional strength and sealing capabilities.

Figure 3A:
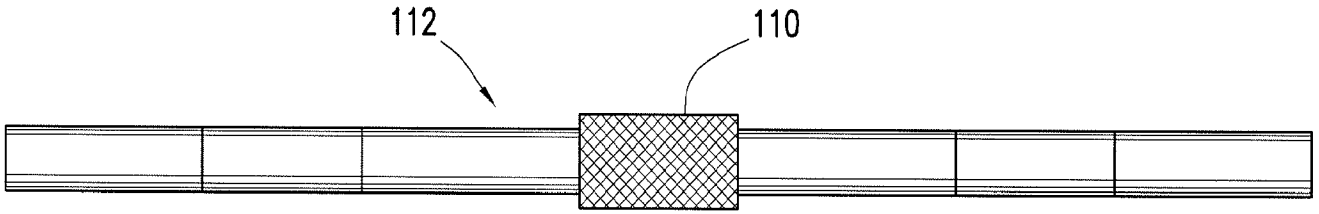
FIGS. 3A and 3B illustrate a truss structure disposed on an expansion tool in contracted and expanded configurations, respectively, according to one or more embodiments.
Figure 3B:
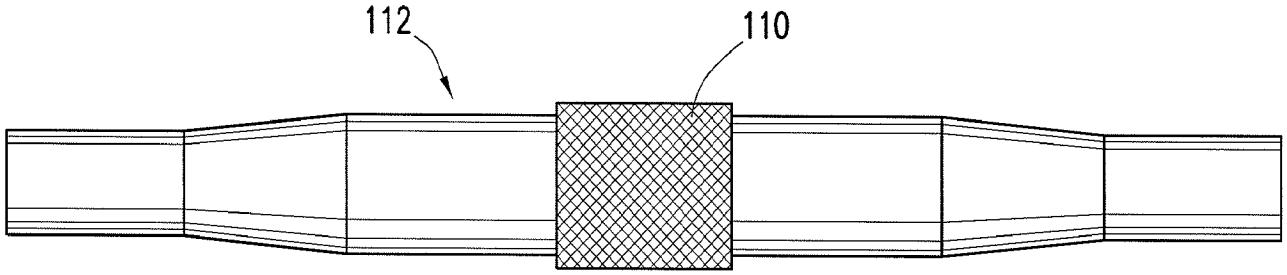

The sealing element/tube assembly may be expanded in a number of different ways (e.g., a cone, downhole power unit, etc.), but one embodiment is expansion via a hydraulic inflation tool 112, such as an inflatable packer, which is shown generally in FIGS. 3A and 3B. FIG. 3A illustrates the truss structure 110 in its collapsed/contracted configuration disposed on a hydraulic inflation tool 112. FIG. 3B illustrates the truss structure 110 in its expanded configuration upon activation of the hydraulic inflation tool 112. In one embodiment, the truss structure 110 is formed of a sheet metal having memory characteristics.

In certain embodiments, the truss structure 110 is formed by cutting the desired pattern into a 2.5 to 3 inch diameter, 30 inch long, schedule 40/80 stainless steel pipe. As those of ordinary skill in the art will appreciate, the size and composition of the truss structure 110 is not limited to this exemplary embodiment. Further, it will be appreciated that the truss structure 110 may be formed using any suitable manufacturing technique including, but not limited to, casting, 3D printing, etc. In the illustrated embodiment, the cut pattern is formed of a plurality of rows 114 of perforations disposed equidistant around the circumference of the truss structure 110. These perforations may form a plurality of expandable cells 122 defined on the truss structure 110. Each row 114 is formed of a plurality of generally opposing, longitudinally offset arc-shaped perforations 116, each having a dimple 118 formed in the approximate mid-section of the arc, as shown in FIG. 2A. The arc-shaped perforations 116 are arranged along the length of the truss structure 110 and have holes 120 formed at the beginning and end of each arc. The holes 120 and the arcs 116 may completely penetrate the steel structure of pipe. In other embodiments, the arcs 116 themselves may only partially penetrate through the pipe wall. In still further embodiments, neither the arcs 116 nor the holes 120 may penetrate through the pipe wall. The pattern is preferably cut using a water jet, but may also be cut using a laser.

Each of the expandable cells 122 includes a perimeter that is defined by the arc-shaped perforations 116, the dimples 118, and the holes 120. Upon expansion of the cells 122, the arc-shaped perforations open up and form opposing offset generally pie-shaped openings in the body of the truss structure 110, which are formed along the length of the pipe, as shown in FIG. 2B. It should be apparent that other embodiments are possible, such as where the truss structure 110 uses linear rather than arc-shaped perforations 116. In other embodiments, the perforations 116 are not generally opposing.

It should be noted that any suitable shaped perforations 116 that permit the truss structure 110 to expand may be used in other embodiments. In addition, any suitable number of such perforations 116 may be utilized to provide the desired expansion. Furthermore, any suitable relationship between the perforations 116 may be contemplated in the disclosed embodiments. Still further, the openings 122 in the body of the truss structure 110 may have any suitable shaped upon expansion of the truss structure 110.

Figure 4:
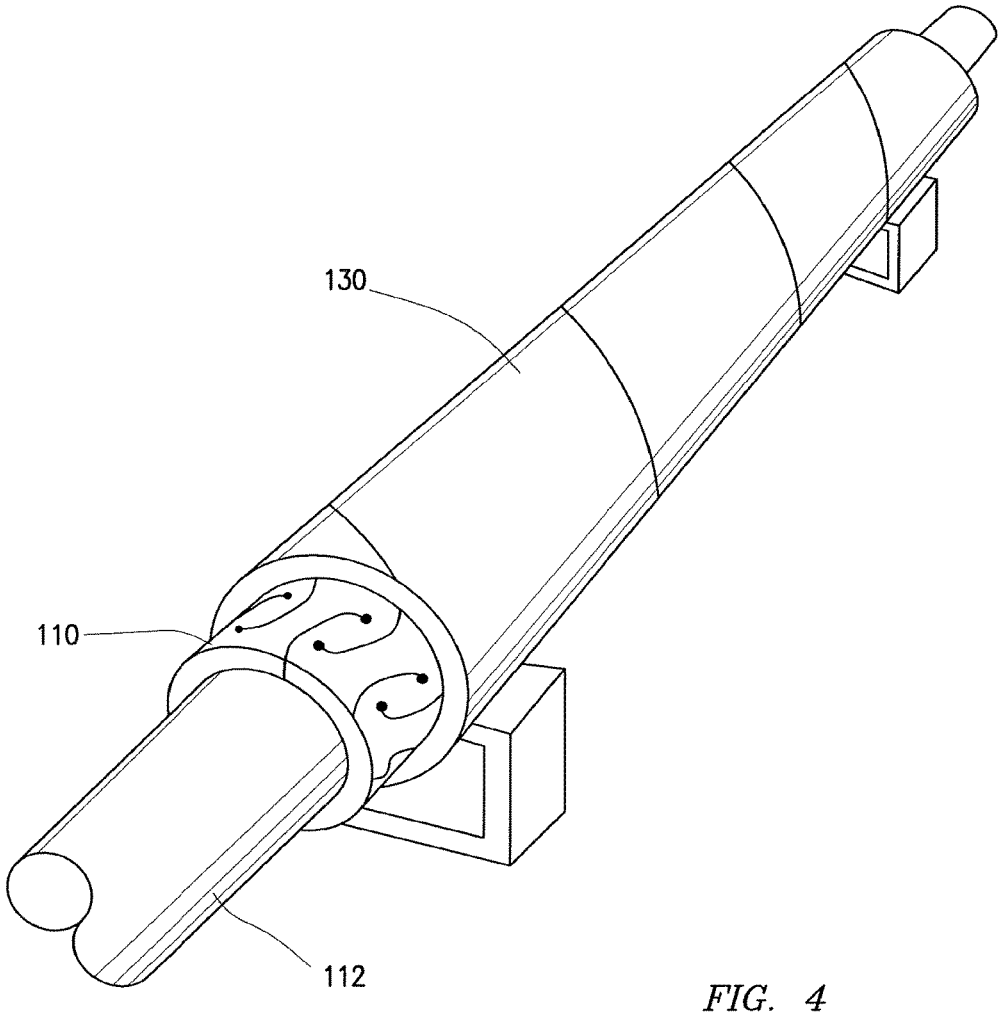
FIG. 4 illustrates a sealing structure layered on a truss structure, with an expansion tool inserted inside of the truss structure with the truss and sealing structures in retracted configurations, according to one or more embodiments.

The run-in configuration of the downhole completion system 100 is shown in FIG. 4, with a sealing structure 130 disposed on the truss structure 110. The sealing structure 130 is an elongate tubular member. In some embodiments, the sealing structure 130 may be formed by coiling a sealing material around the truss structure 110. The sealing material may be formed of rubber; thermoset plastics; thermoplastics;

fiber-reinforced composites; cementious compositions; corrugated, crenulated, circular, looped or spiral metal or metal alloy; any combination of the forgoing; or any other suitable sealing material. As illustrated, the truss structure 110 may be nested inside the sealing structure 130 when the sealing structure 130 is in its contracted configuration. In some embodiments, multiple truss structures 110 may be nested to create a longer length.

Figure 5:
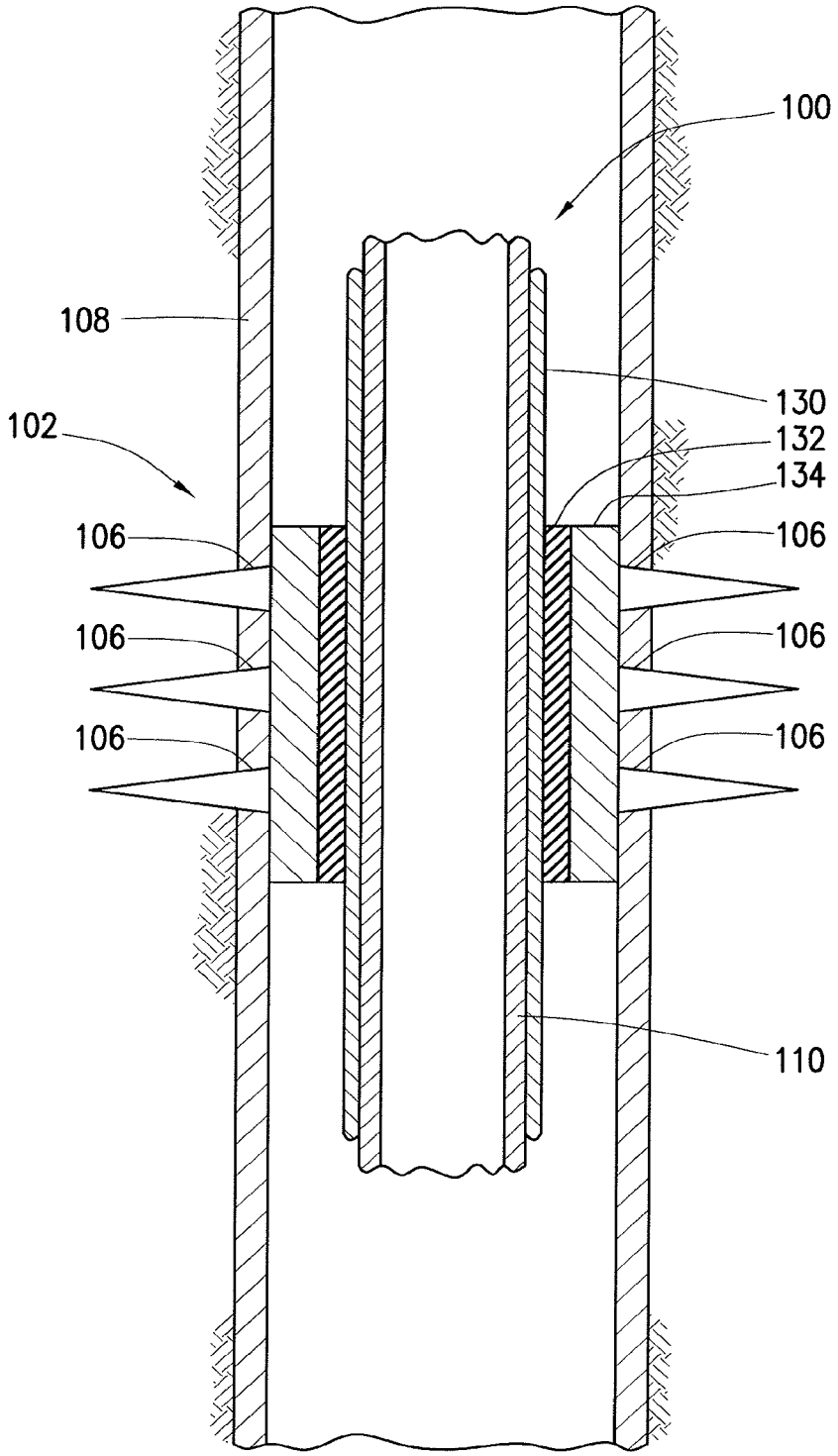
FIG. 5 is a cross-sectional view of truss and sealing structures in expanded configurations showing the sealing structure in engagement with a set of perforations, according to one or more embodiments.

In some embodiments, the sealing structure 130 may further include a scaling element 132 disposed about at least a portion of the outer circumferential surface of the sealing structure, as illustrated in FIG. 5. In some embodiments, an additional layer of protective material 134 may surround the outer surface of the sealing element 132 to protect the sealing element 132 as it is advanced through the wellbore. The protective material 134 may further provide external support to the sealing structure 130. For example, the protective material 134 may provide external support to the sealing structure 130 (and truss structure) by holding the sealing structure 130 under a maximum running diameter prior to the placement and expansion of the truss structure within the casing 108. The term "maximum running diameter" refers to a diameter which the sealing structure 130 is not exceed while the downhole completion system 100 is being run through tubing in the wellbore. Indeed, the protective material 134 may exert a slight compressive force on the sealing structure 130 (and the truss structure) to maintain these structures in a compressed position while the system is lowered through the wellbore. After reaching the appropriate position in the wellbore, an inflation tool, as described above, may exert a force on the inside surface of the truss structure that opposes and overcomes the compressive force from the protective material 134 in order to expand the completion system 100.

In operation, the sealing element 132 may be configured to expand as the sealing structure 130 expands and ultimately engage and seal against the inner diameter of the casing 108. In some embodiments, the sealing element 132 may be arranged at two or more discrete locations along the length of the sealing structure 130. In some embodiments, the sealing element 132 may be arranged at a location along the length of the sealing structure 130 that corresponds with the location of the perforations 106 through which production fluids would otherwise enter the casing 108. The sealing element 132 may be made of an elastomer, a rubber, or any other suitable material. The sealing element 132 may further be formed from a swellable or non-swellable material. In at least one embodiment, the sealing element 132 may be a swellable elastomer that swells in the presence of at least one of water and oil. However, it will be appreciated than any suitable swellable material may be employed and remain within the scope of the present disclosure.

In other embodiments, the material for the sealing elements 132 may vary along the sealing section in order to create the best sealing available for the fluid type that the particular seal element may be exposed to. For instance, one or more bands of sealing materials may be located as desired along the length of the sealing section. The material used for the sealing element 132 may include swellable elastomeric, as described above, and/or bands of viscous fluid. The viscous fluid, for instance, may be an uncured elastomeric that will cure in the presence of well fluids. The viscous fluid may include a silicone that cures with water in some embodiments. In other embodiments, the viscous fluid may include other materials that are a combination of properties, such as a viscous slurry of the silicone and small beads of ceramic or cured elastomeric material. The viscous material may be configured to better conform to the annular space between the expanded sealing structure and the varying shape of the casing 108 and/or the perforations 106. It should be noted that to establish a seal, the material of the sealing element 132 does not need to change properties, but only have sufficient viscosity and length to remain in place the life of the well. The presence of other fillers, such as fibers, may enhance the viscous material.

Figure 6:
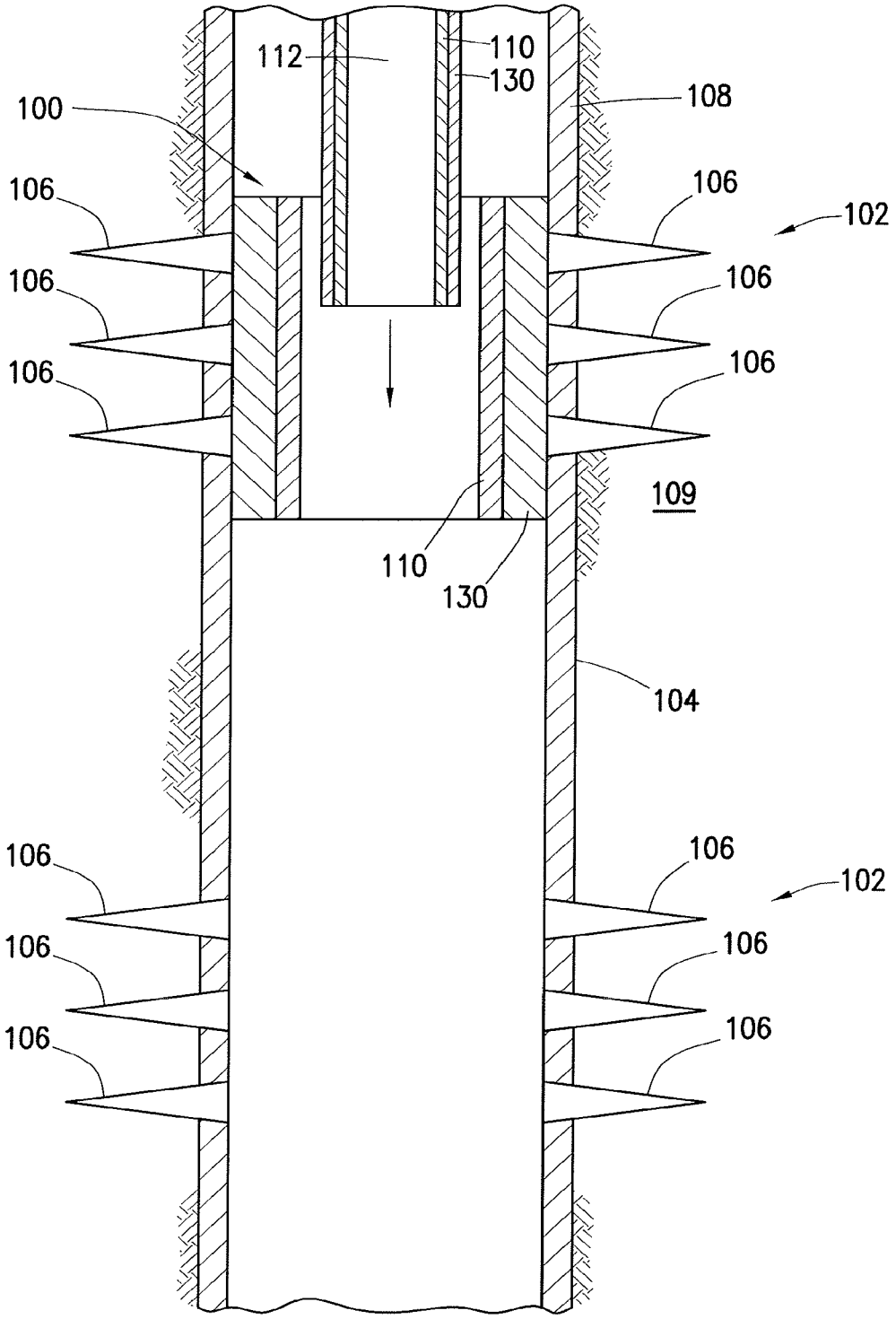
FIG. 6 is a cross-sectional view of truss and sealing structures in expanded configurations showing the downhole completion system in sealing engagement with existing perforations in a nonproductive zone of a wellbore, according to one or more embodiments.

As illustrated, and as will be discussed in greater detail below, at least one truss structure 110 may be generally arranged within a corresponding sealing structure 130 and may be configured to radially expand to seal a previously fractured portion of casing. For example, FIG. 6 illustrates a cross-section of the fractured section 102 of casing 108 being sealed by the downhole completion system 100 described above. As illustrated, the downhole completion system 100 seals off existing perforations 106 through which production fluid would normally flow from the subterranean formation into the casing 108. In the downhole completion system 100, the expanded truss structure 110 holds the sealing structure 130 against these perforations 106, thereby sealing the fractured section 102 so that fracturing fluids may be provided to the formation 106 through the new perforations and not through the old perforations 106. As illustrated, there is no expansion tool present within the system 100, since the expansion tool may function as a deployment device that is removable after being used to expand the system 100 into sealing engagement with the fractured section 102 of casing 108.

In some embodiments, the disclosed system 100 may be capable of sealing 0.75 inch perforations 106. In some embodiments, the system 100 may be able to hold at least approximately 10,000 psi of burst pressure for repeated cycles, which may enable the seals formed by the downhole completion system 100 against the perforations 106 to withstand pressure forces caused by sending pressurized fracturing fluids downhole to refracture multiple wellbore zones.

During installation, the system 100 may be combined with a mechanical connection to the surface for translating the system 100 through the casing 108. The mechanical connection may include a conveyance device used to transport the sealing structure 130 and truss structure 110 in their respective contracted configurations through the casing 108 to the previously fractured section 102. The conveyance device may include a wireline, a slickline, coiled tubing or jointed tubing. In some embodiments, the system 100 may be run into the fractured section 102 in a contracted state on an expansion tool coupled to the mechanical connection prior to expansion via the expansion tool. After expansion of the system 100, the expansion tool may be released and translated out of the casing 108 via the mechanical connection. In some embodiments, the system 100 may be positioned within the fractured section 102 through the use of a spinner, a casing-collar locator, tagging off of a known restriction (e.g., landing nipple), or any other method. In some embodiments, the system 100 may be equipped with a sensor for determining the position of the system 100 with respect to the fractured section 102 and the perforations 106 that need to be sealed.

As mentioned above, the downhole completion system 100 may be utilized to seal a relatively old fractured section 102 of the casing 108 so that another section of the formation may then be fractured. This is illustrated in FIG. 1, which shows a new location 150 for refracturing the wellbore 104, this location 150 being axially removed from the initial fractured section 102. After sealing the old perforations 106 of the fractured section 102 via the system 100, it may be desirable to refracture the formation in the new location 150 by perforating the casing 108 at this location 150 and subsequently or simultaneously treating the formation with, for example, pressurized fracturing fluids and proppant particulates. By sealing the old perforations 106, the downhole completion system 100 may direct the fracturing fluids and other treatments used in refracturing operations through perforations formed in the new location 150 instead of diverting the fluid through the old perforations 106. In addition, sealing the perforations 106 may prevent production fluids produced via the newly fractured section from flowing into the casing 108 via the old perforations 106.

In some embodiments, multiple different fractured sections 102 located along the wellbore 104 may need to be sealed throughout the life of the well. In such situations, multiple downhole completion system 100 may be deployed into the wellbore 104 to seal the fractured sections 102. As illustrated in FIG. 6, one or more of the systems 100 may be translated (in a contracted configuration) through an expanded system 100 that is already sealing the perforations 106 at an upper fractured section 102. In such embodiments the inner diameter of the truss structure 110 in the expanded configuration may be greater than the outer diameter of the downhole completion system 100 in the contracted configuration. Thus, sealing can be provided along the perforations 106 in the casing. In a similar way, it may be desirable to lower additional tools, such as a perforating device and a fracturing device, through the expanded truss structure 110 in order to perform a refracturing operation on lower wellbore zones. The perforating device may include any suitable device for perforating the casing 108. The additional tools may be lowered (e.g., via wireline and the like) through the casing 108 and through the truss structure 110 until they reach a desired lower location of the wellbore 104 where additional perforations are to be created and enhanced.

The disclosed downhole completion system 100 may be deployed directly into the casing 108 to seal perforations 106 at any point along the length of the casing 108 and at any point during production. This allows flexibility in sealing off various fractured sections 102 that are no longer producing, and performing refracturing operations in different zones to increase the amount of formation fluids produced through the wellbore 104. An operator does not have to anticipate which zones of the wellbore 104 might need to be refractured during the lifetime of the well. In addition, the use of the system 100 to seal the perforations 106 at upper fractured sections 102 of the wellbore does not prevent the perforation and treatment of another section of the wellbore 104 further down the wellbore 104.

Embodiments disclosed herein include:

A. A method of refracturing a subterranean formation having casing installed therein that includes conveying a truss structure and sealing structure disposed thereon into the casing adjacent a perforated section of the casing. The truss and sealing structures are radially expandable between a contracted configuration and an expanded configuration. The method also includes expanding the truss and sealing structures from their contracted configurations to an expanded configuration whereby the sealing structure seals against the perforated section of the casing and thereby reduces or restricts fluid flow between the subterranean formation and the inside of the casing, and treating the subterranean formation through open perforations at a location that is axially removed from a location previously fractured.

B. A downhole completion system includes a truss structure, the truss structure and a sealing structure disposed about the truss structure. The truss structure is radially expandable between a contracted configuration and an expanded configuration. The sealing structure is radially expandable between a contracted configuration and an expanded configuration. The sealing structure is operable to seal one or more perforations in a perforated section of casing when in the expanded configuration so as to restrict the flow of fluids through the perforations into a subterranean formation.

Each of the embodiments A and B may have one or more of the following additional elements in combination: Element 1: further including perforating the casing at the location that is axially removed from the location previously fractured. Element 2: further including conveying the sealing and truss structures into the casing simultaneously, the truss structure being nested inside the sealing structure when the sealing structure is in its contracted configuration. Element 3: wherein radially expanding the truss structure into its expanded configuration further comprises expanding a plurality of expandable cells defined on the truss structure. Element 4: wherein the axial length of the truss structure in the contracted and expanded configurations is substantially the same. Element 5: wherein a diameter of the truss structure is expanded by more than 50% when the truss structure is expanded from the contracted configuration to the expanded configuration. Element 6: further including conveying the truss structure and the sealing structure into the casing until the truss structure and the sealing structure are disposed adjacent the perforated section of the casing based on sensor feedback, and radially expanding the truss and sealing structures from their contracted configurations to the expanded configuration when the truss and sealing structures are disposed adjacent the perforated section of the casing. Element 7: further including conveying a second truss structure with a second sealing structure disposed thereon in a contracted configuration into the casing and through the expanded truss structure. Element 8: further comprising conveying a perforating device into the casing and through the expanded truss structure, and perforating the subterranean formation via the perforating device at the location that is axially removed from the location previously fractured.

Element 9: further including a conveyance device to transport the sealing and truss structures in their respective contracted configurations through the casing to the perforated section of casing. Element 10: wherein the conveyance device is selected from the group consisting of wireline, slickline, coiled tubing and jointed tubing. Element 11: further including a deployment device to radially expand the sealing and truss structures from their respective contracted configurations to their respective expanded configurations. Element 12: wherein the deployment device is selected from the group consisting of a hydraulic inflation tool and an inflatable packer. Element 13: wherein when in the expanded configuration the truss structure radially supports the sealing structure. Element 14: wherein the truss structure includes a plurality of expandable cells. Element 15: wherein the truss structure has a diameter which expands by more than 50% when the truss structure is expanded from the contracted configuration to the expanded configuration. Element 16: wherein the axial length of the truss structure in the contracted and expanded configurations is substantially the same. Element 17: wherein an inner diameter of the truss structure in the expanded position is greater than an outer diameter of the sealing structure in the contracted position.

Element 18: wherein a swellable material is disposed about at least a portion of the sealing structure.

Although the present disclosure and its advantages have been described in detail, it should be understood that various changes, substitutions and alterations can be made herein without departing from the spirit and scope of the disclosure as defined by the following claims.

What is claimed is:

1. A method of refracturing a subterranean formation having casing installed therein, said method comprising:

(a) conveying a truss structure and sealing structure disposed thereon into the casing adjacent a perforated section of the casing, wherein the perforated section of the casing comprises a plurality of perforations formed through the casing, said truss and sealing structures being radially expandable between a contracted configuration and an expanded configuration;

(b) expanding the truss and sealing structures from their contracted configurations to an expanded configuration whereby the sealing structure directly contacts and seals against the plurality of perforations and thereby reduces or restricts fluid flow between the subterranean formation and the inside of the casing; and (c) treating the subterranean formation through open perforations at a location that is axially removed from a location previously fractured.

2. The method of claim 1, further comprising perforating the casing at the location that is axially removed from the location previously fractured.

3. The method of claim 1, further comprising conveying the sealing and truss structures into the casing simultaneously, the truss structure being nested inside the sealing structure when the sealing structure is in its contracted configuration.

4. The method of claim 1, wherein radially expanding the truss structure into its expanded configuration further comprises expanding a plurality of expandable cells defined on the truss structure.

5. The method of claim 1, wherein the axial length of the truss structure in the contracted and expanded configurations is substantially the same.

6. The method of claim 1, wherein a diameter of the truss structure is expanded by more than 50% when the truss structure is expanded from the contracted configuration to the expanded configuration.

7. The method of claim 1, further comprising conveying the truss structure and the sealing structure into the casing until the truss structure and the sealing structure are disposed adjacent the perforated section of the casing based on sensor feedback, and radially expanding the truss and sealing structures from their contracted configurations to the expanded configuration when the truss and sealing structures are disposed adjacent the perforated section of the casing.

8. The method of claim 1, further comprising:

conveying a second truss structure having a second sealing structure disposed thereon into the casing with the second truss structure and the second sealing structure being in a contracted configuration;

lowering the second truss structure and the second sealing structure in the contracted configuration through a bore of the expanded truss structure; and expanding the second truss structure and the second sealing structure from their contracted configurations to as expanded configuration whereby the second sealing structure directly contacts and seals against a different plurality of perforations in the casing downhole of the perforated section.

9. The method of claim 1, further comprising conveying a perforating device into the casing and through the expanded truss structure, and perforating the subterranean formation via the perforating device at the location that is axially removed from the location previously fractured.

10. The method of claim 1, further comprising holding the sealing structure against the plurality of perforations via force exerted by the expanded truss structure while treating the subterranean formation, wherein treating the subterranean formation comprises sending pressurized fracturing fluids through the casing to refracture a wellbore zone at the location that is axially removed from the location previously fractured.

11. A downhole completion system, comprising:

(a) a truss structure, the truss structure radially expandable between a contracted configuration and an expanded configuration; and (b) a sealing structure disposed about the truss structure, the sealing structure being radially expandable between a contracted configuration and an expanded configuration, and said sealing structure being operable to directly contact and seal against one or more perforations in a perforated section of casing when in the expanded configuration so as to restrict the flow of fluids through the perforations into a subterranean formation.

12. The downhole completion system according to claim 11, further comprising a conveyance device to transport the sealing and truss structures in their respective contracted configurations through the casing to the perforated section of casing.

13. The downhole completion system according to claim 12, wherein the conveyance device is selected from the group consisting of wireline, slickline, coiled tubing and jointed tubing.

14. The downhole completion system according to claim 11, further comprising a deployment device to radially expand the sealing and truss structures from their respective contracted configurations to their respective expanded configurations.

15. The downhole completion system according to claim 14, wherein the deployment device is selected from the group consisting of a hydraulic inflation tool and an inflatable packer.

16. The downhole completion system according to claim 11, wherein when in the expanded configuration the truss structure exerts a radially outward force that holds the sealing structure against the plurality of perforations.

17. The downhole completion system according to claim 11, wherein the truss structure includes a plurality of expandable cells.

18. The downhole completion system according to claim 11, wherein the truss structure has a diameter which expands by more than 50% when the truss structure is expanded from the contracted configuration to the expanded configuration.

19. The downhole completion system according to claim 11, further comprising a second truss structure having a second sealing structure disposed thereon, wherein an inner diameter of the truss structure in the expanded position is greater than an outer diameter of the second sealing structure in the contracted position such that the second truss structure and the second sealing structure can be lowered downhole through a bore of the expanded truss structure.

20. The downhole completion system according to claim 11, further comprising a swellable material that is disposed on at least a portion of the sealing structure, wherein the swellable material comprises a swellable elastomer that swells in the presence of at least one of water and oil.

* * * * *